United States Patent [19]

Murrill et al.

[11] Patent Number: 4,930,598

[45] Date of Patent: Jun. 5, 1990

[54] SCISSORS LIFT APPARATUS

[75] Inventors: William D. Murrill, Tucker; Mark W. Rhodes, Lawrenceville, both of Ga.

[73] Assignee: 501 Sky Climber, Inc., Stone Mountain, Ga.

[21] Appl. No.: 223,478

[22] Filed: Jul. 25, 1988

[51] Int. Cl.[5] ..... E04G 1/22; E04G 1/34

[52] U.S. Cl. ..... 182/63; 182/141; 187/18

[58] Field of Search ..... 182/63–69, 182/141, 148; 187/18

[56] References Cited

U.S. PATENT DOCUMENTS

| | | | |
|---|---|---|---|
| 93,877 | 8/1869 | Haasz . | |
| 2,734,519 | 2/1956 | Widdowson | 187/18 |
| 3,373,844 | 3/1968 | Schafer . | |
| 3,435,570 | 4/1969 | Berry . | |
| 3,628,771 | 12/1971 | Egeland . | |
| 3,877,544 | 4/1975 | McCollum . | |
| 3,889,778 | 6/1975 | Dotts | 182/63 |
| 3,920,096 | 11/1975 | Fisher | 187/18 |
| 3,982,718 | 9/1976 | Folkenroth | 187/18 |
| 4,088,203 | 5/1978 | Smith . | |
| 4,130,178 | 12/1978 | Smith, Jr. . | |
| 4,175,644 | 11/1979 | Sikli . | |
| 4,375,248 | 3/1983 | Kishi . | |
| 4,657,111 | 4/1987 | Tremblay | 182/141 |

FOREIGN PATENT DOCUMENTS 2105397 3/1983 United Kingdom ..... 182/119

OTHER PUBLICATIONS

"Grove Manlift® Self Propelled Arial Work Platforms–SM 2033E, SM 2633E".

"Grove Nugget TM Manlift", Feb. 1988.

"Mark Industries J Series Scissor Lifts".

"SL/A Series Snorkelift® Rough Terrain Scissor Lift".

"Sky Climber Scissors Lift Family SCI–Series 21, 22, 26, 31, 37 and 47".

*Primary Examiner*—Reinaldo P. Machado

*Attorney, Agent, or Firm*—Jones, Askew & Lunsford

[57] ABSTRACT

A scissors lift apparatus having a wheeled tube chassis and a platform connected together by one or more scissors arm assemblies, each scissors arm assembly including a center arm and two outside support arms pivotally connected at their longitudinal midpoint, adjacent scissors arm assemblies connected in series at the ends of the center arms and at the ends of the outside support arms, a hydraulic cylinder pivotally connected to the chassis and pivotally connected to the pivot axis of the lowermost scissors arm assembly, the pivot connection between adjacent outside support arms comprising common castings, each casting having a pair of longitudinally extending, longitudinally offset ears, the ears of one casting engaged and pinned with the ears of a second axially rotated casting.

35 Claims, 8 Drawing Sheets

SCISSORS LIFT APPARATUS

Technical Field

The present invention relates to a scissors lift apparatus. More particularly, the present invention relates to an improved apparatus which reduces lateral sway when the scissors lift apparatus is erected into an operating position, lowers the center of gravity of the apparatus, permits use of a smaller hydraulic cylinder for raising and lowering the apparatus, and provides a support arm pivot connection which increases the distribution of shear forces on the pivot point.

Background of the Invention

Buildings with high ceilings, such as auditoriums, warehouses, and the like, often require routine maintenance of lighting and other ceiling fixtures. Storage racks in warehouses typically extend to the ceiling area. Various apparatus is available to provide workers access to these elevated areas. Such devices include ladders, semi-automatic and automatic pickers for warehouse racks, and scissors lift platform apparatus. Construction sites also use scissors lift apparatus to elevate workers and materials to a work area, and truck mounted scissors lifts elevate supplies to loading doors on aircraft. These are a few of the uses for scissors lift apparatus.

Such scissors lift apparatus generally include a support frame and a work platform. The platform connects to the support frame by interconnected scissors arm assemblies. The support frame itself may be a wheeled mobile chassis, a truck frame, a railroad car, a stationary support plate or frame, and the like. The scissors assemblies pivotally connect pairs of beams. A series of such assemblies pivotally connect at the ends of the beams with adjacent assemblies to form the scissors lift structure. A force applied to at least one pair of crossed beams is transmitted to the entire structure and causes the crossed beams to open and close and thereby raise and lower the structure.

U.S. Pat. No. 3,373,844 describes a mechanized self-contained scaffold assembly using lazy tong construction. The lazy tong assemblies include a pair of crossed bars mounted on tie rods at their crossing points. An additional set of crossed bars connect to the upper end of an adjacent set of cross bars and likewise are pivotally mounted at their crossing point by a tie rod. Similar assemblies may be included with the uppermost assembly supporting a platform which remains level while the scaffold is erected by means of a cable and drum mechanism. One crossbar of the lower lazy tong assembly is pivotally pinned to the base. The lower end of its associated second crossbar includes a roller which travels on a longitudinally extending guiderail fixed to the base.

U.S. Pat. No. 3,628,771 describes an elevator utilizing a scissors-type lifting linkage. The variation of the lifting force is minimized by utilizing a pivot offset below the planes formed by the two frames of the scissors-type linkage and attaching the lifting means above the plane of one of the frames.

U.S. Pat. No. 4,175,644 describes a scissors lift which includes one or more vertically positioned hydraulic cylinders mounted on scissors linkage to exert a thrust primarily in the direction of the load for all positions of the linkages, to provide an essentially constant load/thrust-speed ratio for all positions, and to permit full extension of the linkages without excessive movement of the hydraulic piston. Ear shaped brackets at the end of the arms of the scissors linkages displace the pivotal axis between the arms away from the horizontal axes of the respective arms. This permits the arms to be folded down directly on top of one another when the lift is in a collapsed position. This is described as permitting the lift to be collapsed to a minimum height and providing a minimum stress at the pivot points of the arms when the linkage is in its lowermost position.

U.S. Pat. No. 4,375,248 describes a hydraulically driven lifting apparatus to elevate a platform. The platform elevates on a plurality of linked mechanisms of the pantograph type comprising plural pairs of link units disposed in parallel relationship on opposite sides of the apparatus. One link unit comprises a pair of link levers rotatably connected to each other at their mid-portions to form an X shape. Each end of the link lever is rotatably connected to an end of an adjacent upper or lower link lever by a connecting rod. The platform is raised by activating a hydraulic cylinder to increase the distance between rotatable shafts. Chains driven by sprocket wheels on the shafts pull in opposite directions. This results in a diverging movement of the link levers about the connecting rod. The link mechanism stretches upward and raises the platform.

These known lifting apparatus generally use scissors arm assemblies having an outer arm and an inner arm pivotally connected to form an X or cross-strut system. Two sets of such arms connect together with one set on each side of the lifting apparatus. Each arm individually has three pivot points or rotary fixation points that allow the opposing arms to form a cross-strut system. Arms of adjacent assemblies connect at their ends to form a parallelogram of continuing, overlapping cross-bracing similar to that of a truss but with interactive movement at their connections.

Such a cross-strut design has certain drawbacks which until the present invention have been accepted by the industry. In particular, the parallel arm design contributes to side sway of the work deck or platform connected to the upper cross arm assembly. Persons working or moving on the elevated platform of known scissors lift apparatus may experience a rocking unstable sensation. Uneven surfaces on which the chassis rests and wind also increase a susceptibility to tip. The lifting and support arms of known lift apparatus provide little torsional rigidity which is among the contributing factors for side sway.

Other factors contributing to the side sway problem are hinge pin clearances and torsional movement of the main support structure or chassis in response to the elevated platform. Generally, the chassis used with these lift apparatus is assembled in a rectangular shape from pieces of tubing or channels. Such a support structure has minimal torsional resistant properties. As the scissors arm elevates, the chassis structure experiences torque and the horizontal deflections of the platform become magnified. Also, an inefficient, loose pivot connection can cost up to three percent, or more, of the force necessary to move the pivotally connected arms.

Known scissors lift apparatus use hydraulic cylinders to elevate the platform from a collapsed to a raised operating position. Some known apparatus position several small low capacity hydraulic cylinders vertically in the crossbar assemblies. Hydraulic hoses thread through the crossbar assemblies. Positioning hydraulic cylinders relatively high in the scissors lift contributes to a high center of gravity and increases the tendency of the lift to sway or tip.

Other known scissors lifting apparatus use a larger hydraulic cylinder that pivots from a horizontal to a vertical position as the crossbar assemblies extend in a divergent manner from a collapsed position to an erect position. When such a cylinder is initially activated with the apparatus in a collapsed position, the force of the cylinder is operating substantially laterally. The vertical component of force is relatively small and the initial elevation and the final descent of the platform in some known lift apparatus is not smooth. Such elevation changes occur in irregular increments and the jumps contribute to a sense of instability experienced by persons standing on the platform.

The scissors lift apparatus of the present invention accordingly overcomes the deficiencies of previously known scissors lift vehicles.

Brief Summary of the Invention

The present invention provides a scissors lift apparatus having a work platform which may be raised from and lowered to a support base by at least one scissors arm assembly. Each scissors arm assembly is made from a center arm box girder and two outside support arms. The three arms pivotally connect at their longitudinal midpoint to define a pivot axis for the assembly. Adjacent scissors arm assemblies pivotally connect in series a center arm end to an adjacent center arm end so that the center arms extend from the support base to the work platform. Similarly, the outside support arms extend from the support base to the work platform to further support the platform and to guide the vertical travel of the platform. Adjacent scissors arm assemblies pivotally connect in series an end of a pair of outside support arms to an end of a pair of adjacent outside support arms.

The present invention provides as a support base a tubular chassis to which the lowermost scissors arm assembly connects. One arm of the assembly (such as the center arm in the illustrated embodiment) pins at one end to the chassis and the pivotally connected associated cross arm (or pair of outside support arms) connect to a roller or travelling block permitting translation of the outside arm ends parallel to the longitudinal axis of the chassis. The high torsional rigidity of the elongate tube chassis contributes to the increased stability of the lift apparatus. The chassis is mobile, and includes a steer drive front wheel system and a rear idler axle to which are mounted wheels.

A reversible outer arm casting rigidly attaches to the longitudinal ends of each outside support arm. The casting includes two longitudinally extending ears which are laterally offset with respect to the longitudinal axis. The ears of a similar casting rotated about the longitudinal axis of the arm engage the ears of a confronting casting to form a pivotable connection for the outside support arms to which the castings are attached. Each ear is approximately one-fourth the width of the base and a first ear extends from the base with its outside surface adjacent the lateral side of the base. A second ear extends from the base linearly with the longitudinal axis of the base and with an inside surface facing the first ear. Both ears thus define a gap about one-fourth the width of the base. The related ears and gap enables pinned pivotal coupling of the ears of adjacent castings.

A hydraulic cylinder pivotally connects in the chassis and pivotally connects to the pivot axis of the lowermost scissors arm assembly. Extension of the hydraulic cylinder causes the scissors assemblies to extend and elevate the platform. Connecting the hydraulic cylinder to the pivot axis permits the apparatus of the present invention to use a smaller hydraulic cylinder than apparatus positioning the hydraulic cylinder away from the pivot axis.

The present invention accordingly provides a lifting structure with high torsional rigidity in both the support base and the arms of the scissors assemblies. The tubular chassis provides a stable support platform having high torsional rigidity in both the longitudinal and transverse axes. The pivotal connections between the scissors assemblies linked in series are minimized to reduce frictional loss of lifting capacity. The respective arms of the scissors assemblies connecting in series further provide increased stability. Orientation of the hydraulic cylinder permits the apparatus to have a significant vertical component when the cylinder is initially activated to raise the work platform smoothly with regular changes in elevation.

Side sway in an elevated scissors lift is potentially dangerous; an elevated platform has a high moment arm about the chassis. It is an object of the present invention to provide a scissors lift apparatus which reduces the side sway of an elevated platform.

A chassis structure which uses "bed-frame" construction contributes to vehicle instability. It is an object of the present invention to provide a chassis with increased torsional stability.

Further, it is an object of the present invention to provide an arm for scissors assemblies having high torsional rigidity along both its longitudinal axis and its transverse axis. Such assemblies provide a more stable elevation for a platform.

Even though the scissors assemblies of the present invention have high torsional rigidity, it is desirable that the assembly structures not be excessively heavy. Additional mass contributes to the moment arm about the chassis, raises the center of gravity, and increases side sway. It is an object of the present invention to provide a lightweight, high strength scissors arm assembly.

It is an object of the present invention to provide a scissors lift assembly with the platform weight carried substantially by the center arms pivotally connected in series, and the outside support arms also pivotally connected in series to support the work platform and to guide its elevation.

It is an object of the present invention to minimize the reduction in the lifting efficiency caused by mechanical interconnections of the scissors lift assemblies.

It is an object of the present invention to reduce shear and bending stresses in the interconnecting pivot joints of the outside support arms.

Pinning the hydraulic cylinder low in the chassis and connecting its upper end to the pivot axis of the lowermost scissors assembly applies the elevating force more directly to the mass to be lifted. It is thus an object of the present invention to provide a scissors lift apparatus using a relatively smaller hydraulic cylinder to lift the platform than a cylinder necessary for previous lifts having a similar capacity platform.

It is further an object of the present invention to provide a lift apparatus with a low center of gravity.

It is an object of the present invention to provide a scissors lift apparatus which elevates smoothly without irregular motion or irregular changes in elevation for increased safety and increased operator confidence in the apparatus integrity.

The objects and advantages of the present invention will become further apparent upon a review of the following detailed description of the disclosed embodiments and the appended drawings and claims.

Description of the Preferred Embodiments

Figure 1:
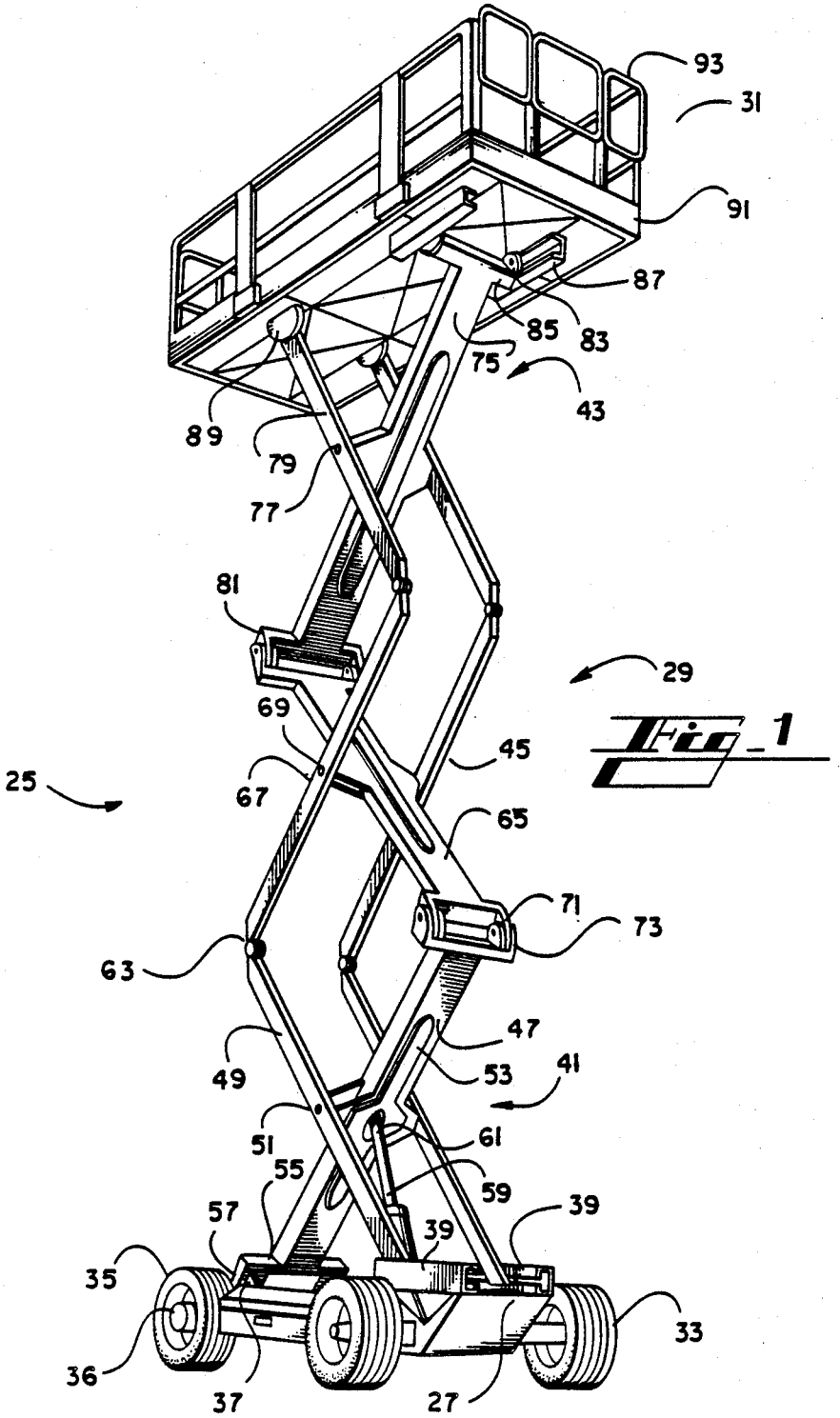
FIG. 1 is a perspective view of a disclosed embodiment of a scissors lift apparatus according to the present invention erected to an operating position.

With reference to the drawing in which like numbers indicate like elements, FIG. 1 is a perspective view of a mobile scissors lift apparatus 25 according to the present invention erected to an operating position. The scissors lift apparatus 25 includes a chassis 27, scissors lift assemblies 29 and a platform 31. The chassis 27 is mobile and includes a set of rear wheels 33 and a set of steerable front wheels 35. Drive motors or gears 36 operatively connect with the front wheels to propel the chassis 27. A pair of ears 37 project from the top side of the chassis 27 at the front. A pair of roller tracks 39 extend longitudinally on the upper surface from the end of the chassis 27.

The illustrated apparatus 25 includes three lift arm assemblies. The lower assembly 41 connects to the chassis 27. The upper assembly 43 connects to the platform 31. An intermediate assembly 45 pivotally connects at its ends to the lower assembly 41 and the upper assembly 43. Each lifting arm assembly 41, 43, and 45 includes a center lift arm and two outside support arms. These three arms pivotally connect at their longitudinal midpoints. In a preferred embodiment, the center lift arm and the outside support arms are longitudinal tubes. The center arm preferably is a box girder with at least one interior baffle dividing the arm into sections.

The lower lifting arm assembly 41 includes a center lift arm 47 and two outside support arms 49. The support arms 49 pivotally connect to the center arm 47 at a pivot point 51. A doubler plate 53 strengthens and supports the lower flange surface of the lift arm 47. A similar doubler plate 53 secures to the upper flange surface of the lift arm 47. The lower end 56 of the center lift arm 47 terminates in a cross tube 55. Connector ears 57 extend from the cross tube 55 and pin to the ears 37. In a preferred embodiment, a single stroke hydraulic cylinder 59 pivotally connects between the chassis 27 and the pivot point 51 of the lower arm assembly 41. An alternate embodiment uses a telescopic hydraulic cylinder. A cylinder rod 61 of the cylinder 59 extends through an opening in the bottom flange of the center arm 47. The lower ends of the outside arms 49 connect to rollers (not illustrated) which travel in the guiderails 39. The guiderails 39 have a square C-shape in cross-section. An alternate embodiment uses low friction bearing blocks (not illustrated) instead of wheels to travel in the guiderails 39. A common outer ear connector 63 attaches to the upper ends of the outside arms 49.

The intermediate lift arm assembly 45 includes a center lift arm 65 and two outside support arms 67. The outside support arms 67 connect to the center arm 65 at a pivot point 69. The outside arms 67 terminate in a connector 63. Two connectors 63 pin together in confronting relation to form a pivotable connection between adjacent outside support arms. The ears 71 extending from the intermediate center arm 65 pin to the ears 73 from the lower center arm 47 to form a pivotable connection for the adjacent center arms.

The upper arm assembly 43 also includes a center lift arm 75 connected at a pivot point 77 to a pair of outside support arms 79. The lower end of the arm 75 connects by pinned ears 81 to the upper end of the intermediate arm 65. The ears 83 extend from a cross tube 85 at the upper end of the arm 75. Rollers (not illustrated) connect to the ears 83 and travel in a pair of longitudinal platform guiderails 87. The upper end of the outside support arms 79 pins to ears 89 attached to the underside of the platform 31. The platform 31 includes a base 91 and railings 93.

Figure 2:
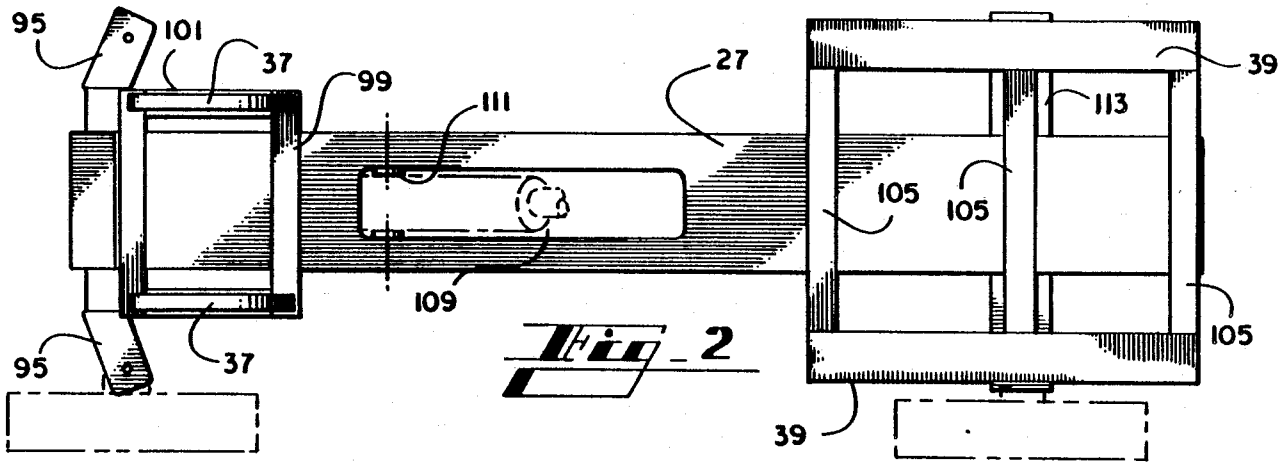
FIG. 2 is a top view of the partially assembled chassis for the lifting apparatus illustrated in FIG. 1 with the chassis wheels illustrated in phantom.

FIG. 2 is a top view of a partially assembled chassis 27 according to the present invention with the chassis wheels 33 and 35 on one side illustrated in phantom. A steer axle 95 connects to the chassis 27 as part of the steer drive module sub-assembly. Steer drive sub-assemblies, such as an Ackerman steering assembly, are known in the art and one of ordinary skill may without undue experimentation adapt such a steering drive assembly to the tubular chassis of the present invention.

Rigidly connected to the top of the chassis tube 27 is the center arm support frame 97. The frame 97 includes two cross tubes 99 and two side tubes 101 connected at their ends to define the rectangular frame 97. The sides of the chassis include square U-shaped cut-outs in which the cross tubes 99 insert. The center arm attaching ears 37 secures to the top surface of the frame 97.

A rear arm support frame 103 rigidly connects at the back end of the chassis tube 27. Cut-outs in the sides of the chassis receive and support three cross tubes 106. Side tubes 105 (best seen in FIG. 3) connect at their ends to the cross tubes 106 to assemble the rectangular frame 103. The parallel and longitudinally extending roller tracks 39 rigidly connect to the frame 103.

The upper flange of the tube 27 includes an opening 109 for the hydraulic cylinder 59. A pair of bosses 111 are secured in the tube 27 and with a pin extended through the bosses 111 cooperate to provide a pivot connection for the hydraulic cylinder 59.

Figure 3:
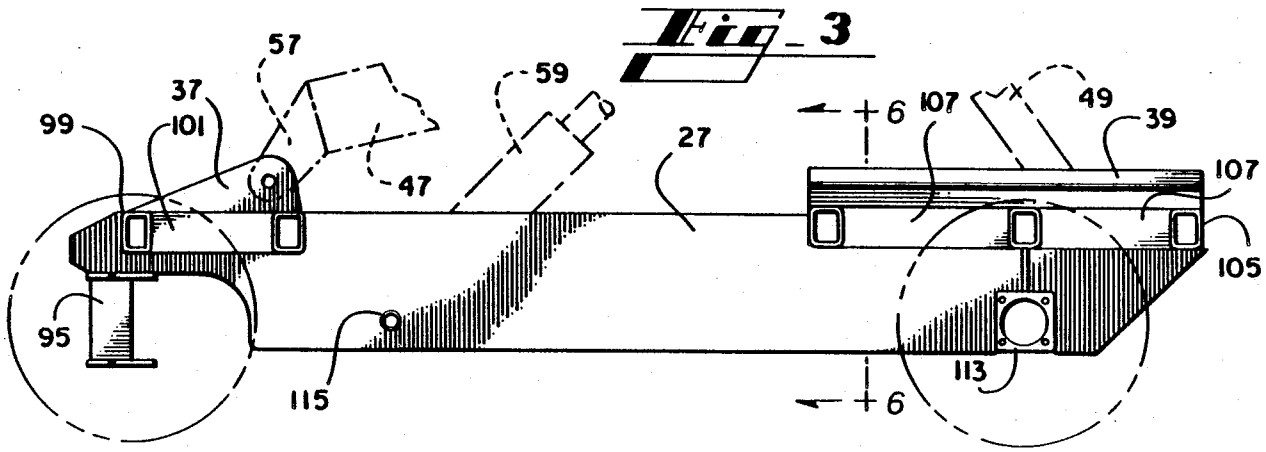
FIG. 3 is a side view of the partially assembled chassis illustrated in FIG. 2 with the chassis wheels, hydraulic cylinder, and portions of the lowermost scissors assembly illustrated in phantom.

FIG. 3 provides a side view of the partially assembled chassis 27 illustrated in FIG. 2. Further, the hydraulic cylinder 59 and portions of the lowermost scissors assembly 41 are shown in phantom. The side tubes 107 connect at their ends to the cross tubes 105 to define the outside arm support frame 103. An idler axle module 113 connects to the underside of the main chassis tube 27 and supports the axle for the rear wheels 33. A bore 115 permits the pin to pass through the chassis tube and the bosses 111 for the hydraulic cylinder 59. An alternate embodiment (not illustrated) positions the longitudinal guiderails 39 lower in the chassis tube 29. The outside arm support frame 103 is rigidly connected above the top surface of the idler axle module 113. The guiderails 39 are welded to the interior side walls of the tube 29. In this embodiment, the center cross tube 106 illustrated in FIG. 2 is removed and the side tubes 107 connect instead to the idler axle module 113.

Figure 4:
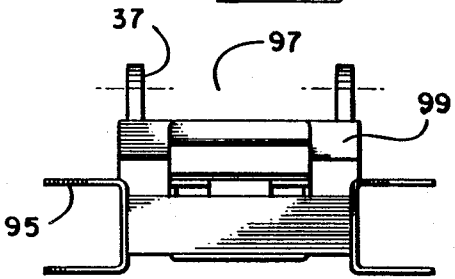
FIG. 4 is a front view of the partially assembled chassis illustrated in FIG. 2.

FIG. 4 is a front view of the partially assembled chassis 27 illustrated in FIG. 2. The steering axle 95 connects to the front of the chassis 27. The ears 37 project upwardly from the center arm support frame 97.

Figure 5:
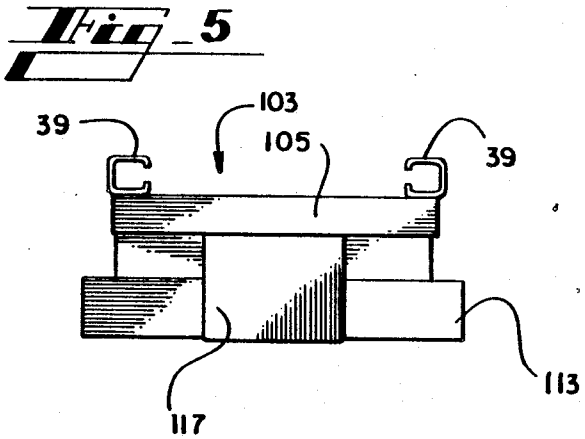
FIG. 5 is a rear view of the partially assembled chassis illustrated in FIG. 2.

FIG. 5 is a rear end view of the partially assembled chassis 27 illustrated in FIG. 2. Rollers (not illustrated) connect to the lower ends of the outside support arms 49. The rollers travel in the roller guide track 39 rigidly attached to the outside arm support frame 103. An end plate 117 closes the tube 27.

Figure 6:
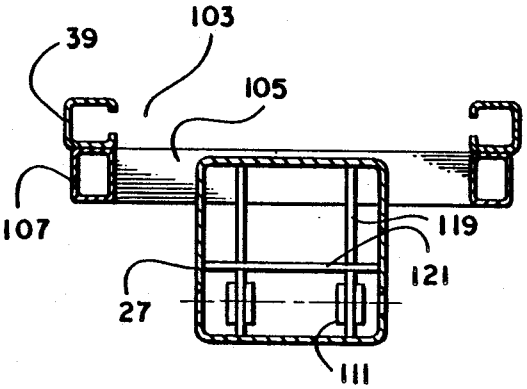
FIG. 6 is a cross-sectional view of the partially assembled chassis according to the present invention taken along line 6—6 of FIG. 3.

FIG. 6 is a cross-sectional view of the partially assembled chassis 27 taken through lines 6—6 of FIG. 3. The chassis 27 is a longitudinally extending tube. The boss 111 is supported in the tube 27 by a pair of vertically disposed support plates 119 and a horizontal cross plate 121.

Figure 7:
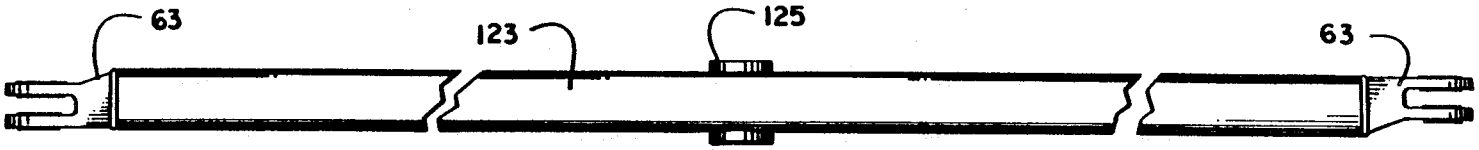
FIG. 7 is a plan view of a disclosed embodiment of an outside support arm according to the present invention.
Figure 8:
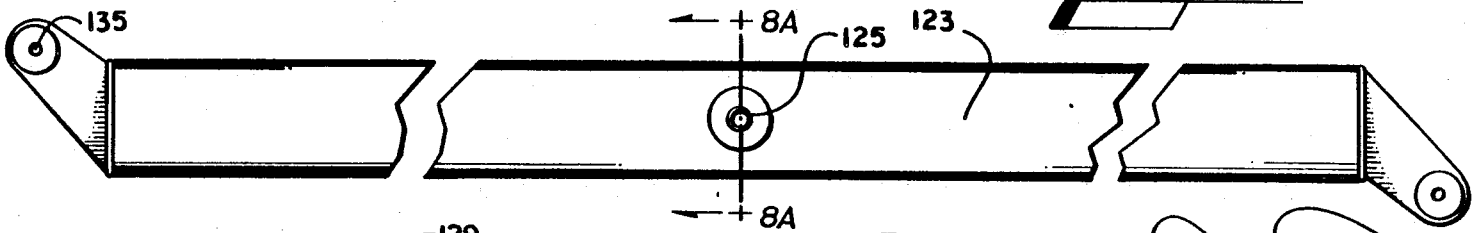
FIG. 8 is a side view of the outside support arm illustrated in FIG. 7.
Figure 8A:
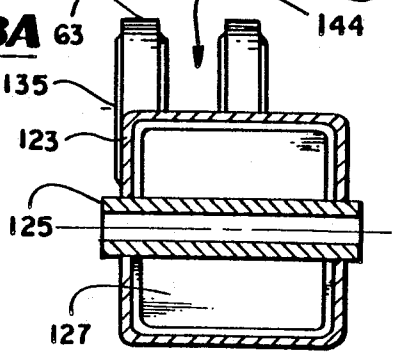
FIG. 8A is a cross-sectional view of the outside support arm illustrated in FIG. 8 taken through line 8A—8A.

An outside support arm 123, such as the arm 49, 67 or 79, is illustrated in plan view in FIG. 7 and in side view in FIG. 8. A boss 125 extends through the web of the tube 123 at its midpoint. The boss 125 cooperates with a pin to define a pivot connection between the outside support arms and a center arm of the present invention. The outside support arm 123 preferably is a longitudinally extended hollow tube which in cross-section defines a rectangle and is more clearly shown in a cross-sectional view in FIG. 8A. An alternate embodiment uses an I-beam or an H-beam for the outside support arm. One connector 63 of the present invention rigidly attaches at each longitudinal end of the arm 123. As will be explained in more detail, the connector 63 is reversible permitting two connectors 63 to cooperate and form a pivot connection between two outer arm tubes 123. FIG. 8 illustrates a connector **63*a* angling upward at one end of the tube 123 with a second connector 63*b* rotated 180 degrees around the longitudinal axis to angle downward. An upwardly angled connector 63 from one arm 123 cooperates with a downwardly angled connector 63 from an adjacent arm 123** to form a pivot connection between the two arms.

Figure 9:
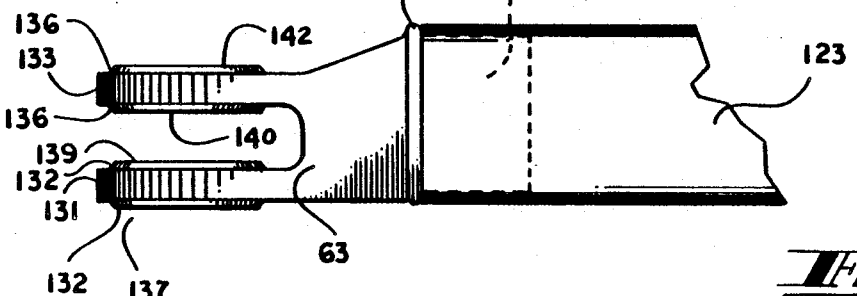
FIG. 9 is a detail plan view of an end of the outside support arm illustrated in FIG. 7 further illustrating the pivot connection for the outside support arm.

FIG. 9 is an enlarged view of the ear connector 63 of the present invention. The connector 63 includes a connector insert tube 127 which slides into the open end of the tube 123. A stop 129 forms a raised ridge radially around the periphery of the tube 127 and butts against the end of the tube 123. Extending laterally from the connector 63 are a pair of parallel ears 131 and 133. Each ear 131 and 133 includes a bore 135 sized to accept a pin. The ears 131 and 133 may include, as illustrated, a coaxial boss 132 and 136, and a bushing may be inserted in the bore 135. The ear 131 has an outer side 137 and an inner side 139. As illustrated in FIG. 9, the outside surface 137 of the ear 131 extends substantially linearly with the outside surface of the arm 123. The width of the ear through its boss 135 is approximately one-fourth the width of the arm 123. The ear 133 similarly has an inner side surface 140 and an outer side surface 142. The inner side surface 140 extends substantially linearly along a line projecting from the longitudinal axis of the connector 63. The width of the ear 133 through the boss 135 is approximately one-fourth the width of the connector 63. The two ears 131 and 133 accordingly define a gap 144 between their respective inside surfaces 139 and 140. The gap in a preferred embodiment is about one-fourth the width of the arm 123.

Figure 10A:
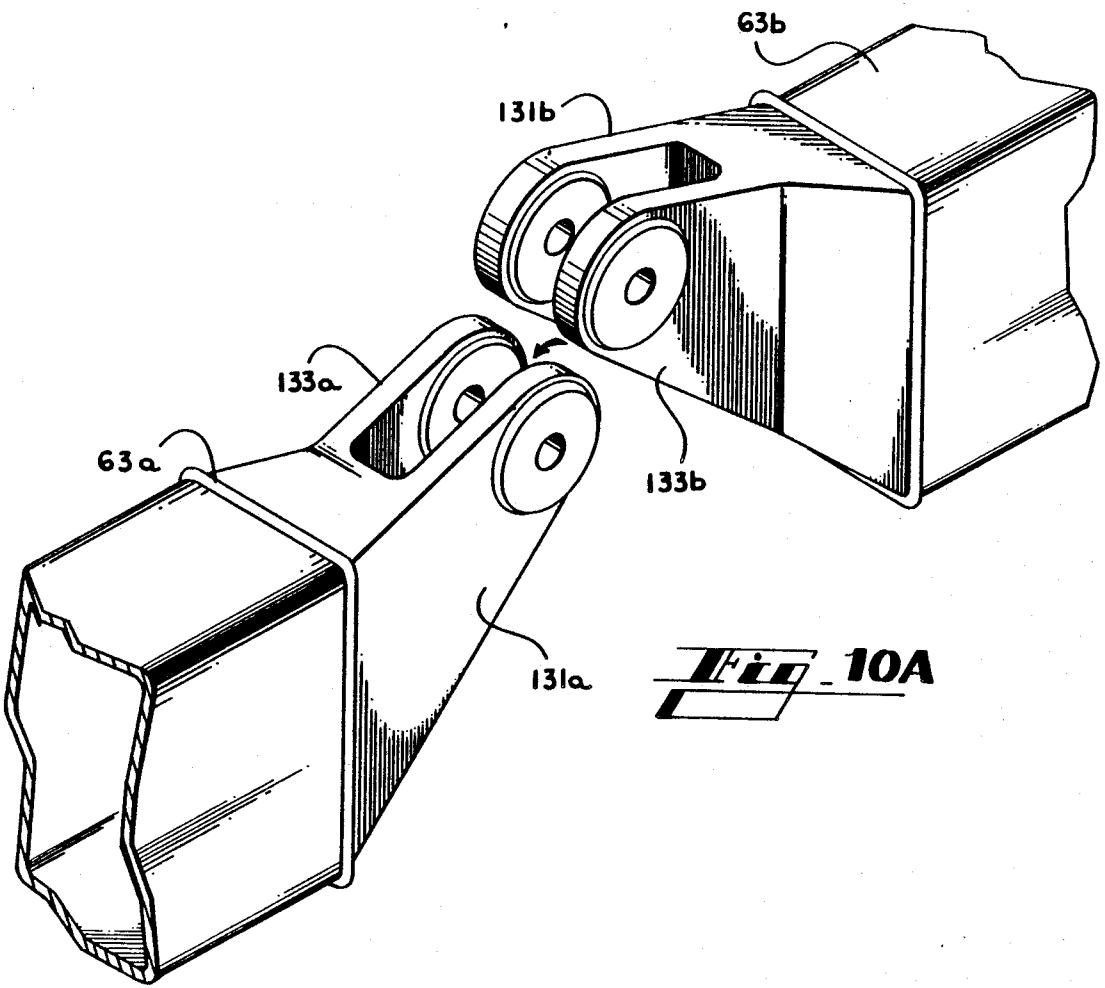
FIG. 10A is an exploded illustration of a disclosed embodiment of two pivot connections for the outside support arms.
Figure 10B:
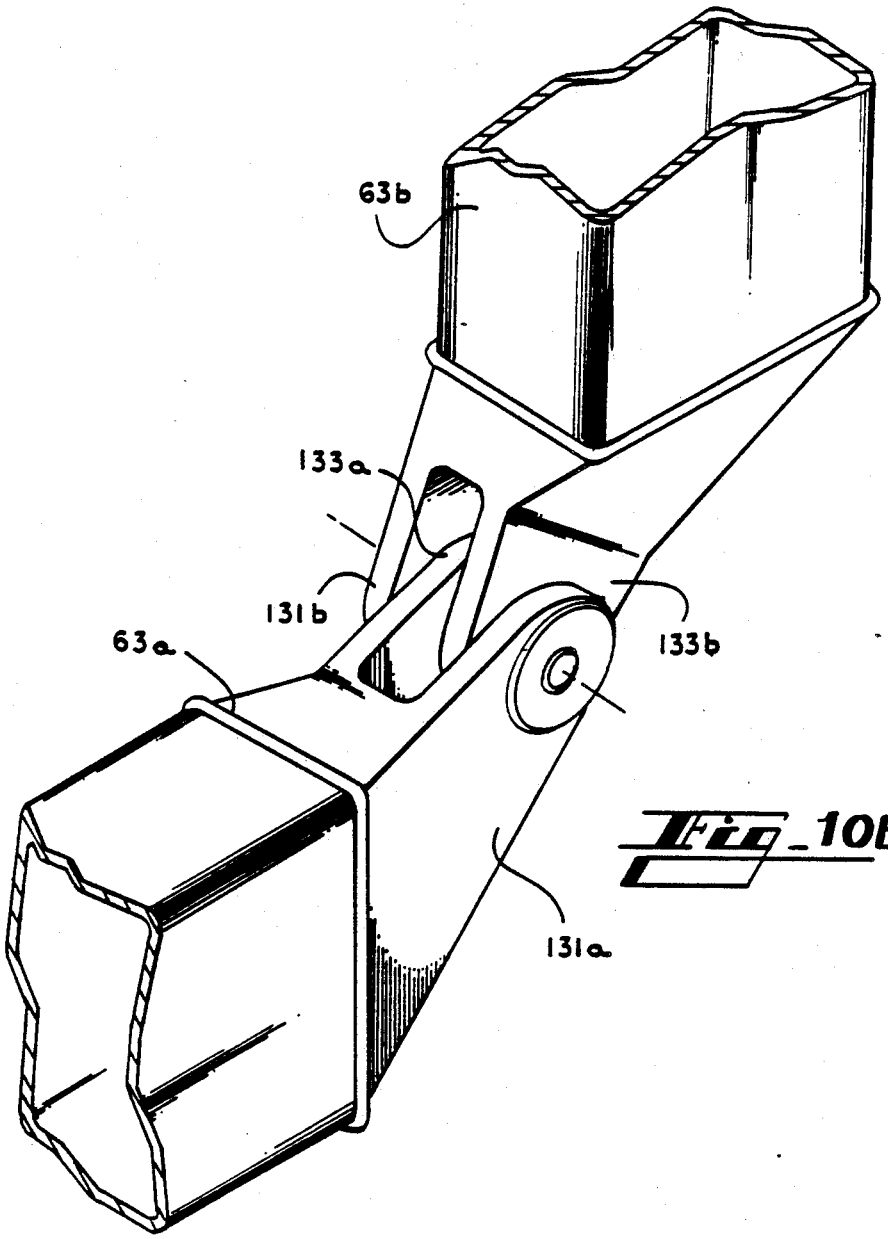
FIG. 10B is a perspective view of a disclosed embodiment of the pivot connectors for the outside arms according to the present invention.

As illustrated in FIG. 10A, the connector 63 is reversible by rotating the connector 63 axially 180 degrees around the longitudinal axis permitting two connectors 63 to engage and pin together for a pivot connection. Interposed in the gap 144 between the ears **131*a* and 133*a* of the connector 63*a* is the ear 133*b* of the connector 63*b*. The ear 133*a* accordingly positions in the gap between the ear 131*b* and the ear 133*b* of the connector 63*b*. A pin (not illustrated) passes through the coaxial bore 135 in the ears 131 and 133 to join the connector 63*a* and 63*b* together. The two connectors 63*a* and 63*b* pivot about the pin connection 135** as illustrated in FIG. 10B.

Figures 11, 12:
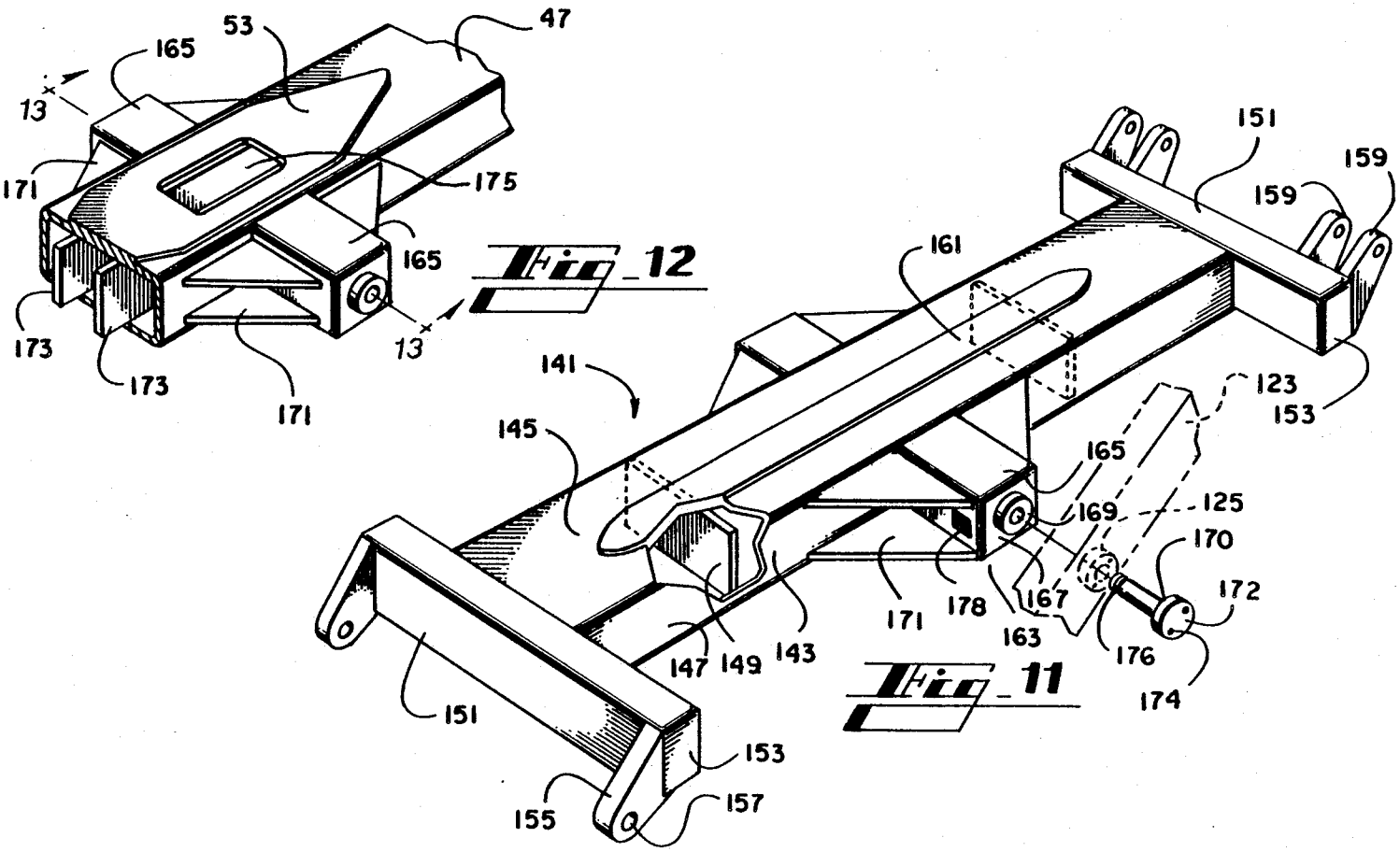
FIG. 11 is a perspective, partially cut-away view of a disclosed embodiment of a center arm according to the present invention with a cut-away outside support arm illustrated in phantom.
FIG. 12 is a perspective, cut-away view of a disclosed embodiment of a center arm of the present invention which couples with the hydraulic lifting cylinder.

FIG. 11 is a perspective, partially cut-away view of a center arm assembly 141 according to the present invention with a cut-away outside support arm illustrated in phantom. Each center arm 141, such as the center arms 47, 65, and 75, preferably is assembled from a box girder 143 which is a longitudinally extending rectangular tube having top and bottom flange surfaces 145 and side web surfaces 147. A pair of baffles 149 are disposed perpendicular to the longitudinal axis of the box girder 143 to divide the arm 141 into sections. Compared with the overall length of the center arm, each section has a relatively short longitudinal axis. This increases the torsional rigidity of the center arm tube. The baffles 149 are rigidly connected to the interior walls of the box girder 143. A cross tube 151 connects at each longitudinal end of the box girder 143. An end plate 153 closes the ends of the cross tube 151. Interconnecting ears 155 attach adjacent the ends of the cross tube 151 and in longitudinal cross-section, the ears 155 define a D-shape although other shapes may readily be used. Each ear 155 includes a bore 157 sized to accept a pin (not illustrated). The single ear 159 pins to the double ears 159 of an adjacent center arm assembly to form a pivot connection between the two center arm assemblies. A doubler plate 161 rigidly connects to the exterior flange surfaces 145 of the box girder 143.

The longitudinal midpoint of the box girder 143 becomes the pivot point for the center arm. Pivot connections 163 for the outside support arms 123 attach to the web 147 perpendicular to the longitudinal axis of the box girder 143. Each connector 163 includes a center pivot support tube 165. The tube 165 is capped with an end plate 167 which has a center bore and bushing 169 sized to accept a pin 170. A gusset plate 171 provides side support for the center pivot support tube 165. The illustrated embodiment of the present invention has gusset plates 171 coplanar with the flange of the box girder 143. An alternate embodiment offsets the gussets 171 vertically on the web of the box girder 143 as illustrated in FIG. 12.

The outside support arm 123 pins to the box girder 143 as illustrated in FIG. 11. The pin 170 has a head 172 in which are drilled two axial bolt holes 174. The bushing 125 of the outside support arm 123 is tapped to engage securely the threads of bolts placed in the holes 174. The distal end of the pin 170 includes a retaining ring groove 176. The web of the connector tube 163 includes an opening 178 which may be closed with a cover (not illustrated). The opening 178 provides access to the interior of the tube 163 to install a retaining ring in the groove 176. When the scissors arm assemblies 29 are assembled, the support arm 123 is pivotally connected by the pin 170 which extends through the bore 125 of the outer arm tube 123 and the bushing 169 of the connector tube 163. A retaining ring is inserted through the opening 178 and placed on the groove 176. Two bolts are inserted through the bolt holes 174 and securely tightened into the tapped bushing 125 to fix the pin 170 with respect to the outside support arm. This provides a double lock pinning system using the pin, the bolts and the retaining ring to pivotally connect the outside support arm 123 to the center arm 141.

The center arm assembly for the lower arm 47 also includes a sub-assembly for connecting the piston 61 of the hydraulic cylinder 59 to the lower center arm 47. Illustrated in FIG. 12 is a perspective cut-away view of the lower center arm 47. A pair of ribs 173 extend longitudinally in the box girder 143 of the lower center arm assembly 47 adjacent the pivot point 51. The ribs 173 are perpendicular to the longitudinal axis of the pivot support tube 165. The center arm and the outside support arms pivot about this axis. The cylinder rod (or pin eye) 61 of the hydraulic cylinder 59 extends through the opening 175 in the flange bottom and the doubler plate 53. The top flange also includes the opening 175 for access to the cylinder rod sub-assembly. The opening 175 in the top flange is closed with a removable cover plate (not illustrated).

Figure 13:
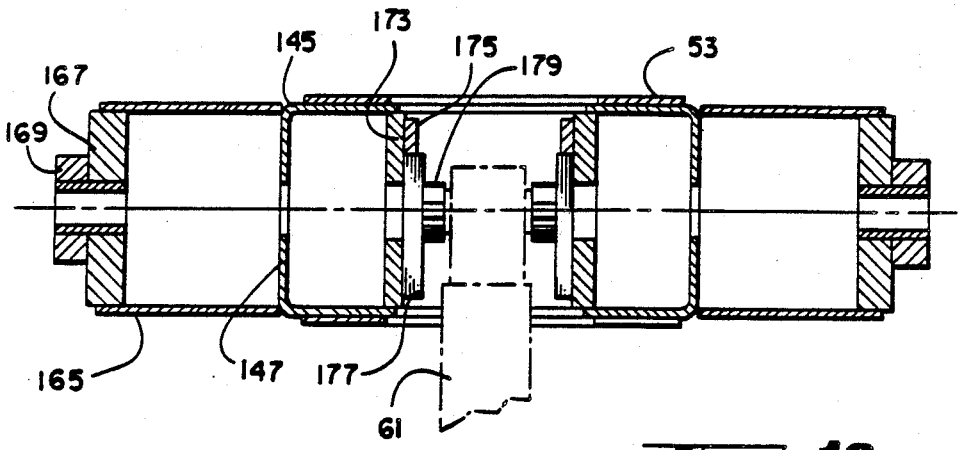
FIG. 13 is a cross-section view of a disclosed embodiment of a pivot connection for the lower center arm illustrating the connection of the hydraulic cylinder to the center arm in accordance with the present invention.

FIG. 13 provides a cross-sectional view of the lower center arm 47 taken along line 13—13 of FIG. 12. Attached to the rib 173 is a stop plate 175. The rib 173 extends vertically between the upper and lower flange surfaces 145 of the box girder 143. The doubler plate 53 rigidly attaches to the flange surfaces 145. The center pivot support tube 165 connects to the web 147 perpendicular to the longitudinal axis of the box girder 143. The end plate 167 caps the tube 165 and a boss 169 defines a bore in the end plate 167. A pin couples an outside support arm 123 with the center pivot support tube 165. A shear plate 177 bolts to the rib 173. A post 179 extends from the shear plate 177, and a pin 181 extends through the pin eye in the cylinder rod 61 and engages the bore of the pivot post 179. An alternate embodiment uses two hydraulic cylinders.

Figure 14:
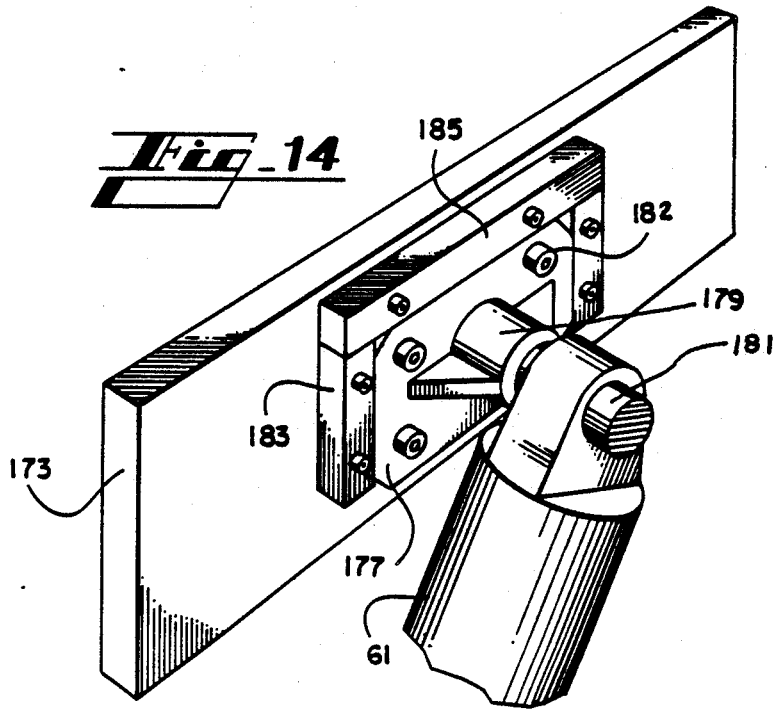
FIG. 14 is a perspective detail illustration of a disclosed embodiment of a hydraulic cylinder connection to the support members in the lower center arm assembly in accordance with the present invention.

The sub-assembly for connecting the cylinder rod 61 to the lower center arm 47 is better illustrated in FIG. 14. Bolts 182 rigidly connect the plate 177 to the rib 173. Two side bars 183 and a longitudinal attaching bar 185 rigidly connect to the rib 173. In a preferred embodiment, the bars 183 and 185 weld to the rib 173. In an alternate embodiment the attaching bars bolt to the rib 173. The attaching bars 183 and 185 define a pocket in which the shear plate 177 nests and provide additional rigidity and strength to the cylinder connection sub-assembly.

With reference to FIG. 1, the scissors lift apparatus includes a rigid tube chassis 27, a plurality of scissors lift assemblies 29, and a platform 31. The tubular chassis 27 has high torsional rigidity and thus contributes to the increased stability of the lift apparatus. The chassis 27 includes a drive motor or engine and electrohydraulic components of the lift apparatus. The platform 31 includes a operators' panel with controls for driving and steering the chassis 27 and for elevating and lowering the platform 31. Control wires connect the electrohydraulic components on the support chassis 27 with the operator control panel on the platform 31. In a preferred embodiment, the wires route in conduit through the center arms. Holes (not illustrated) in the cross tube 151 and the baffle plate 149 permit the wires to thread through the center arms. A strain relief plate (not illustrated) mounts to the cross tube 151, and together with an appropriate length of exposed flexible conduit, permit articulation of the scissors assembly 29 without chafing or cutting of the control wires.

The platform 31 preferably is assembled from tubing and cross members for bracing rigidity. A plywood sheet or boards rest in the tubes for a surface on which workers may stand. As is known in the art, the bottom surface of the platform 31 includes support members on the bottom surface. From these members extend the ears 89 and the longitudinal U-shaped guiderails 87. The railing 93 extends upwardly around the perimeter of the platform 31 and includes a hinged gate for entrance to and exit from the platform 31. The gate preferably is spring biased to close automatically.

As may be appreciated by one of skill in the art, the scissors arm assemblies 29 such as the lower arm 41, the upper arm 43 and the intermediate arm 45, are similar in construction. The box girder 143 illustrated in FIG. 11 includes longitudinal cross members 151 rigidly mounted to the longitudinal ends of the box girder 143. At least one ear 155 extends longitudinally from the cross member 151. The ear 155 pins to ears 159 of an adjacent center arm to form a pivot connection in series between adjacent center arms. The transverse baffle plates 149 stiffen the box girder 143 by reducing the length over which the arm may torque. The longitudinal axis of the center pivot support tube 165 defines a pivot axis to which the outside arms connect. The lower arm 41 illustrated in FIG. 14, however, includes the sub-assembly shear plate 177 and ribs 173 to which is pinned the cylinder rod 61 of the hydraulic cylinder 59. The cylinder rod 61 reaches into the interior of the lower arm 41 through the opening 175 in the bottom flange and the doubler plate 59. The cylinder rod 61 reaches into the interior of the lower arm 41 through the opening 175 in the bottom flange and the doubler plate 59. First, the pin 181 is placed through the pin eye of the cylinder rod 61. The pin 181 couples to a pair of shear plates 177. The pivot post 179 extending from a shear plate 177 receives an end of the pin 161. This assembly of shear plates 177 and the pin 181 inserts through the opening 175 in the bottom flange of the center arm 47 and with access provided through the opening 175 in the top flange, the shear plates 177 are bolted to the ribs 173.

The outside support arms of the present invention are illustrated in FIGS. 7, 8, 8A, and 9. The outer support arm 123 preferably is a longitudinally extending metal tube but in an alternate embodiment may be an I-beam or an H-beam. The boss 125 extends through the web of the tube 123 at its longitudinal midpoint. The ends of the tube 123 are capped with a reversible common outer arm connector 63 illustrated in FIG. 9. The connector tube 127 slidably inserts into the open end of the tube 123 and the stop 129 butts against the end of the tube 123. The connector 63 is welded in place where the stop 129 contacts the end of the tube 123. As illustrated in FIGS. 10A and 10B, the reversible connectors **63*a* and 63*b* engage to form a pivot connection between adjacent outer arm tubes 123. The pivot connector 63** distributes the shear forces on the pin over three shear lines.

With reference to FIG. 1, it may be appreciated that the scissors lift apparatus according to the present invention may include only the lower scissors arm assembly 41. In this instance, the ear 73 of the lower center arm would include rollers to travel in the U-shaped guiderail 87 of the platform 31. Similarly, the connector 63 of the outside support arm 49 would pin to the ear 89 of the platform 31. An alternate embodiment of the present invention includes two scissors lift arm assemblies 29. In the two stage embodiment (or other embodiments having an even number of center arm assemblies 29) the upper ends of the outside support arms 67 couple to rollers which travel in the U-shaped guiderail 87. The ears 159 extending from the center arm cross tube 151, as shown in FIG. 11, pin to the ears 89 depending from the platform 31.

Thus, the present invention provides a scissors lift apparatus in which the center lift arms 141 as illustrated in FIG. 11 connect in series, such as the arms 47, 65, and 75 illustrated in FIG. 1. The outside support arms similarly connect in series, such as the arms 49, 67, and 79 also illustrated in FIG. 1. For both the chassis 27 and the platform 31, one cross arm of the scissors lift assembly pins to the chassis 27 or the platform 31 while the other cross arm connects to rollers which travel in guiderails 39 or 87 on the chassis 27 or platform 31, respectively.

The present invention further provides a chassis having increased torsional stability over the rectangular "bed frame" chassis previously known. The chassis 27 having increased torsional stability assembles from a longitudinally extending tube as illustrated in FIGS. 2–6. The cross tubes 99 and 105 in the center arm support frame and the rear arm attaching frame contribute to the torsional rigidity of the tube 27. Additionally, the transverse idler axle module 113 illustrated in FIGS. 2 and 3 provides torsional rigidity for the chassis 27. The rear wheels 33 connect by conventional means to the idler axle module 113. In an alternate embodiment, outriggers or other stabilizers attach to the sides of the chassis 27 adjacent the longitudinal ends. These outriggers extend and firmly plant on the ground or floor to provide a firm foundation for the lift apparatus 25.

The support frame 111 for the hydraulic lift cylinder 59 further contributes to the rigidity of the chassis 27. The frame 111 includes a horizontal cross plate 121 and two vertically disposed support plates 119. The bosses 111 in the plates 119 are co-axial with the bore 115 in the webs of the chassis 27. A pivot pin or axle extends through the bore 115 and the bosses 111 to provide a pivot for the hydraulic cylinder 59. The hydraulic cylinder pins to the plates 119 low in the chassis 27. The hydraulic cylinder 59 thus angles upwardly to its connection in the lower center arm 47. Even with the scissors assembly in a fully lowered position, the hydraulic cylinder 59 is at an angle with respect to horizontal. Thus, when the cylinder 59 is initially activated, the force has a significant vertical component. This reduces the tendency of the scissor lift apparatus to abruptly jerk and bounce during the initial elevation or final descent of the scissor lift assemblies, but rather provides a smooth, regular change in elevation.

As explained above, a worker standing on the platform 31 of the illustrated embodiment shown in FIG. 1 operates the control panel to drive the scissors lift 25 and to raise and lower the platform 31. A joystick or other device operatively associated with the front drive steering system permits the operator to steer the direction of the lift apparatus 25. Drive motors or an engine coupled to drive gears 36 in the front wheels 35 propel the lift apparatus 25 forward and reverse in response to operation of the controls. The lift apparatus 25 preferably is driven to the work area with the platform 31 in a lowered position. When the lift apparatus 25 is positioned where the elevated work is to be done, the worker operates the controls to selectively elevate the work platform to a desired height. The hydraulic cylinder 59 provides smooth changes in elevation.

The hydraulic cylinder 59 pins at its lower end in the chassis 27. Hoses couple the cylinder 59 to an appropriate hydraulic pump and supply of hydraulic fluid held in compartments on the chassis 27. Activation of the hydraulic cylinder 59 extends the cylinder rod 61 and applies a force at the pivot axis of the scissor arm. The cylinder rod 61 pushes against the pin 181 positioned between the two sheer plates 177 attached to the longitudinal ribs 173 in the lowermost scissors arm assembly. The force from the cylinder 59 rotates the center arm 47 around the pin connection 57 with the chassis 27. As the free end of the arm 47 rises, the outside arms 49 pivot around the pivot axis 51 and the end moves away from its lowered position adjacent the pin connection 57. The lower ends of the outside arms 49 move longitudinally beside the guiderails 39 towards the pin 57 to permit the scissor arm 41 to rise.

Simultaneously, the intermediate arm assembly 45 and the upper arm assembly 43 pivot in response to the force from the hydraulic cylinder 59. The pivot connection 69 and 77 enables the upper ends of the center arms 65 and 75 to move away from the adjacent lower ends of the outside support arms 67 and 79. The outside support arms articulate at the connectors 63 to guide the vertical travel of the platform 31. The upper ends of the outside support arms 79 pin to the ear 89 on the bottom of the platform 31. Rollers engaged in the guiderails 87 permit the upper end of the center arm 75 to move longitudinally from the end of the guiderail 87.

The hydraulic cylinder continues to extend the cylinder rod 59 pushing the scissors assemblies to pivot upwardly. The operator stops the elevation of the platform 31 when it reaches an appropriate work height. A safety stop as is known in the art prevents over extension.

To lower the platform, the hydraulic cylinder 59 again is activated and the cylinder rod 59 retracted. The force pulls on the scissor arm 41 along its pivot axis 51. The scissor assembly 41 begins to close with the upper end of the center arm 47 rotating downward around the pin 57. The wheels or sliding blocks connected to the lower ends of the outside arms 49 travel in the guiderails 39 to move the outside arm ends longitudinally towards the end of the chassis 27. The upper end of the center arm 75 travels longitudinally adjacent the guiderails 87. The intermediate scissor arm 45 and the upper scissor arm 43 similarly pivot around their respective pivot axes 69 and 77. The upper ends of each center arm move towards the lower ends of the outside support arms. The converging movement lowers the height of the scissor assembly and thus lowers the platform 31.

The principles, preferred embodiments, and modes of operation of the present invention have been described in the foregoing specification. The invention is not to be construed as limited to the particular forms disclosed, since these are regarded as illustrative rather than restrictive. Moreover, variations and changes may be made by those skilled in the art without departing from the spirit of the invention as described by the following claims.

What is claimed is:

1. A scissors lift apparatus comprising:

a support;

a platform;

a plurality of scissor arm assemblies connecting the support to the platform, each arm assembly comprising a center arm and two outside support arms pivotably connected at their longitudinal midpoints to define a pivot axis, adjacent assemblies pivotally connecting in series a center arm end to an adjacent center arm end and outside arm ends to adjacent outside arm ends;

pin and roller means for connecting the lowermost scissor arm assembly to the support for connecting the uppermost scissor arm assembly to the platform; and a hydraulic cylinder pivotally mounted to the support and to the longitudinal midpoint of the center arm of the lowermost scissor arm assembly.

2. The scissors lift apparatus as recited in claim 1, wherein the support comprises:

a chassis; and wheel means on which the chassis moves.

3. The scissors lift apparatus as recited in claim 2, wherein the chassis comprises:

a longitudinal tube;

a pair of ears connected adjacent a first end of the tube;

a pair of longitudinally extending guiderails connected to the tube distal from the first end; and means for connecting the hydraulic cylinder to the tube between the ears and the guiderails.

4. The scissors lift apparatus as recited in claim 3, wherein the chassis further comprises:

a front frame mounted to the tube, the ears extending from the front frame; and a back frame rigidly attached to the tube, the back frame supporting the guiderails.

5. The scissors lift apparatus as recited in claim 1, wherein the center arm comprises:

a box girder;

a crossbar at the longitudinal ends of the girder; and at least one ear extending from the longitudinal ends of each crossbar.

6. The scissors lift apparatus as recited in claim 5, wherein the box girder includes at least one interior baffle.

7. The scissors lift apparatus as recited in claim 5, wherein the center arm further comprises a pair of doubler plates, a doubler plate rigidly attached to a top flange and a bottom flange of the box girder.

8. The scissors lift apparatus as recited in claim 1, wherein each scissors arm assembly further comprises:

a pair of tubes extending laterally from the center arm coaxial with the pivot axis;

an end plate to cap each tube, the end cap having a bore to accept a pin for pivotally connecting the outside arm to the center arm.

9. The scissors lift apparatus as recited in claim 1, wherein each scissors arm assembly further comprises:

a base rigidly attached to the longitudinal ends of the outside support arm;

a first ear extending from the base having an outside surface substantially colinearly with the side surface of the base and having a width about one-fourth the width of the base; and a second ear extending from the base having an inside surface extending substantially colinearly along the longitudinal axis of the base and having a width of about one-fourth the width of the base.

10. The scissors lift apparatus as recited in claim 1, wherein each outside support arm is a tube.

11. A scissors arm apparatus, comprising:

a chassis;

a platform;

an odd number greater than 2 of scissor arm assemblies, each assembly comprising:

a center arm;

a pair of outside support members pivotally connected at their longitudinal midpoint to the center arm;

means for pivotally connecting one end of a center arm with an end of an adjacent center arm; and means for pivotally connecting the related ends of the outside arms with related ends of adjacent outside arms;

pin means for connecting the lowermost center arm to the chassis;

roller means for connecting the lowermost outside arms to the chassis;

second pin means for connecting the uppermost outside arms to the platform;

second roller means for connecting the uppermost center arm to the platform; and a hydraulic cylinder pivotally connected at one end to the chassis and at the other end to the longitudinal midpoint of the center arm of the lowermost arm assembly.

12. A scissors lift apparatus, comprising:

a chassis;

a platform;

a scissors arm assembly connecting the chassis to the platform, comprising a center arm and two outside support arms pivotally connected at their longitudinal midpoint to define a pivot axis;

pin means for connecting the lower end of the center arm to the chassis;

roller means for connecting the lower ends of the outside support arms to the chassis;

second pin means for connecting the upper ends of the outside support arms to the platform;

second roller means for connecting the upper end of the center arm to the platform; and a hydraulic cylinder pivotally mounted to the chassis and to the longitudinal midpoint of the center arm.

13. A scissors lift apparatus comprising:

a chassis;

a platform;

a first and second scissor arm assembly pivotally connected in series, connecting the chassis to the platform, each arm assembly comprising a center arm and two outside support arms pivotally connected at their longitudinal midpoints to define a pivot axis;

pin and roller means for connecting the first assembly to the chassis and connecting the second assembly to the platform; and a hydraulic cylinder pivotally connected to the chassis and to the longitudinal midpoint of the center arm of the arm assembly connected to the chassis.

14. A scissors lift apparatus comprising:

a support base;

a work platform;

a plurality of scissor arm assemblies connecting the support base to the work platform, each of the scissor arm assemblies comprising a center box girder and two outside support arms pivotally connected at their longitudinal midpoints, adjacent scissor arm assemblies pivotally connecting in series a center box girder end to an adjacent center box girder end so that the center box girders extend from the support base to the work platform thereby providing the scissors lift apparatus with improved torsional stability; and a hydraulic cylinder pivotally mounted to the support base and to the longitudinal midpoint of the first adjacent center box girder.

15. The scissors lift apparatus as recited in claim 14, wherein each center box girder includes at least one interior baffle.

16. An outside support arm for a scissors lift assembly, comprising:

a longitudinal member; and a first and a second ear casting, each casting attached to one longitudinal end of the member, comprising:

a base;

a first ear extending from the base having an outside surface extending substantially colinearly with the outside surface of the base and having a width about one-fourth the width of the base; and a second ear extending from the base having an inside surface extending substantially colineraly with the longitudinal axis of the base and having a width about one-fourth the width of the base.

17. The outside support arm as recited in claim 16, wherein the second ear is rotated 180 degrees with respect to the longitudinal axis of the member.

18. The outside support arm as recited in claim 16, wherein each of the first ear and the second ear in longitudinal cross-section defines a D-shape.

19. The outside support arm as recited in claim 16, wherein the first ear and the second ear are coaxially bored to define a bore.

20. The outside support arm as recited in claim 19, further comprising a boss on the sides of the first ear and the second ear coaxial with the bore.

21. The outside support arm as recited in claim 20, further comprising a bushing in each first ear and second ear coaxial with the bore.

22. The outside support arm as recited in claim 16, wherein:

each longitudinal end of the member is open;

the base is a tube sized to fit into the open end of the member; and each casting further comprises a stop on the base extending radially around the periphery transverse to the longitudinal axis.

23. An intermediate scissor arm assembly comprising:

a center arm member having a top and a bottom flange and two side webs;

a pair of outside support arms, one arm pivotally connected to each side web at the longitudinal midpoint of the support arms and the center arm;

a cross member mounted at each longitudinal end of the center arm member;

at least one ear extending from each longitudinal end of the cross member, whereby an end of the center arm connects in series to an end of a center arm of an adjacent scissors arm assembly by pinning the ears of the center arm to the center arm of the adjacent scissors arm assembly; and outside arm connection means for connecting the related ends of the outside support arms in series to related ends of outside support arms of an adjacent scissors arm assembly.

24. The intermediate scissors arm assembly as recited in claim 23, wherein the cross member is a longitudinal tube.

25. The intermediate scissors arm assembly as recited in claim 23, wherein the center arm member is a box girder.

26. The intermediate scissors arm assembly as recited in claim 25, wherein the center tube includes at least one transverse baffle.

27. The intermediate scissors arm assembly of claim 23, further comprising a doubler plate rigidly attached to each of the top flange and the bottom flange.

28. The intermediate scissors arm assembly as recited in claim 23, wherein the outside arm connection means comprises:

a base adapted for rigidly attaching to the end of an outside support arm;

a first ear extending from the base having an outside surface extending substantially linearly with the outside surface of the base and having a width about one-fourth the width of the base; and a second ear extending from the base having an inside surface extending substantially linearly along the longitudinal axis of the base and having a width about one-fourth the width of the base.

29. The intermediate scissors arm assembly as recited in claim 28, wherein the first ear and the second ear are coaxially bored to define a bore.

30. The intermediate scissors arm assembly as recited in claim 28, further comprising a boss coaxial with the bores in both the first ear and the second ear.

31. The intermediate scissors arm assembly as recited in claim 28, further comprising a stop on the base extending radially around the periphery transverse to the longitudinal axis.

32. A connector for pivotally connecting together support members, comprising:

a base adapted for rigidly attaching to the end of a support member;

a first ear extending from the base having an outside surface extending substantially linearly with the outside surface of the base and having a width about one-fourth the width of the base; and a second ear extending from the base having an inside surface extending substantially linearly along the longitudinally axis of the base and having a width about one-fourth the width of the base.

33. The connector as recited in claim 32, wherein the first ear and the second ear are coaxially bored to define a bore.

34. The connector as recited in claim 33, further comprising a boss coaxial with the bores in both the first ear and the second ear.

35. The connector as recited in claim 32, further comprising a stop on the base extending radially around the periphery transverse to the longitudinal axis.

* * * * *